US006243882B1

(12) United States Patent
Kawashima et al.

(10) Patent No.: US 6,243,882 B1
(45) Date of Patent: Jun. 12, 2001

(54) SWIMMING GOGGLES

(75) Inventors: Haruo Kawashima; Masashi Fujiwara; Shunji Fukasawa, all of Tokyo (JP)

(73) Assignee: Tabata Co., Ltd. (JP)

( * ) Notice: Subject to any disclaimer, the term of this patent is extended or adjusted under 35 U.S.C. 154(b) by 0 days.

(21) Appl. No.: 09/505,541

(22) Filed: Feb. 17, 2000

(30) Foreign Application Priority Data

Feb. 17, 1999 (JP) ..... 11-039251

(51) Int. Cl.[7] ..... A61F 9/02
(52) U.S. Cl. ..... 2/428; 2/452
(58) Field of Search ..... 2/428, 430, 429, 2/452, 447, 445; 351/43

(56) References Cited

U.S. PATENT DOCUMENTS 5,459,882 * 10/1995 Yamamoto ..... 2/428
5,628,072 * 5/1997 Haslbeck et al. ..... 2/428
6,145,133 * 11/2000 Sato et al. ..... 2/428

FOREIGN PATENT DOCUMENTS 2570206 2/1998 (JP) .

* cited by examiner

*Primary Examiner*—Peter Nerbun
(74) *Attorney, Agent, or Firm*—Baker & Daniels

(57) ABSTRACT

Swimming goggles include an elastic head strap. Free ends of the strap are guided through first guiding holes and then through second guiding holes. A stopper member is inserted into a gap defined between a peripheral wall of the second guiding hole and the strap. The swimming goggles thus constructed allow a length of the strap once adjusted to be maintained during repeated use of the swimming goggles.

4 Claims, 2 Drawing Sheets

SWIMMING GOGGLES

BACKGROUND OF THE INVENTION

This invention relates to swimming goggles used by swimmers or divers.

Japanese Utility Model Registration Gazette No. 2570206 discloses swimming goggles in which an elastic head strap made of rubber has its opposite free ends guided through strap guiding holes provided at outer ends of respective lens frames from the rear toward the front so that the head strap can be fastened around a goggles' wearer. These free ends are then folded twice or more along supports provided on the outer ends of the respective lens members and thereafter guided through the strap guiding holes from the front toward the rear. Within the strap guiding holes, two sections of the strap are placed against each other and thereby frictionally restrict a relative movement of these two sections. In this manner, the strap is prevented from falling off from the strap guiding holes even when the strap is fastened around the wearer's head and pulled rearward. Thus the head strap is adjusted to a desired length relative to the swimming goggles.

However, the known swimming goggles are not free from a problem such that the free ends of the strap which have been guided through the strap guiding holes may be moved little by little in a direction of falling off every time the head strap contracts during its repeated expansion and contraction. Consequently, after the swimming goggles have been repeatedly put on and taken off, the head strap once adjusted to the optimum length for fitness around the wearer' head may slacken. To correct such inconvenient situation, the length of the head strap must be often readjusted. Certainly, it is possible to inhibit the undesired movement of the free ends by forcibly inserting wedge-like stopper members between peripheral edges of the respective strap guiding holes and the free ends guided through the strap guiding holes, respectively. However, the strap becomes thinner as the strap is stretched and the effect of the stopper members is correspondingly deteriorated and therefore the length of the strap must be readjusted in this case also when the swimming goggles are used for a long period.

SUMMARY OF THE INVENTION

It is an object of this invention to provide swimming goggles that make it unnecessary to readjust the length of a strap thereof.

According to this invention, there is provided swimming goggles having a pair of first strap guiding holes formed on transversely opposite sides thereof and a head strap having longitudinally opposite free ends each adapted to be guided through each of the first strap guiding holes from the rear toward the front, then to be folded twice or more along strap supports formed on the opposite sides and thereby to be length-adjustably fixed to the opposite sides, wherein:

the free end folded twice or more along the strap supports is guided from the front toward the rear through a second strap guiding hole provided independently of the first guiding hole and a stopper member is detachably inserted into a gap defined between a peripheral wall of the second guiding hole and the free end in order to prevent the end from falling off from the second guiding hole from the rear toward the front.

According to one preferred embodiment, the free end extending from the front toward the rear after being folded twice or more along the strap supports is brought in close contact with the portion of the head strap having already left the first guiding hole and thereafter guided through the second guiding hole spaced from the portion of the head strap.

DESCRIPTION OF THE PREFERRED EMBODIMENT

Figure 1:
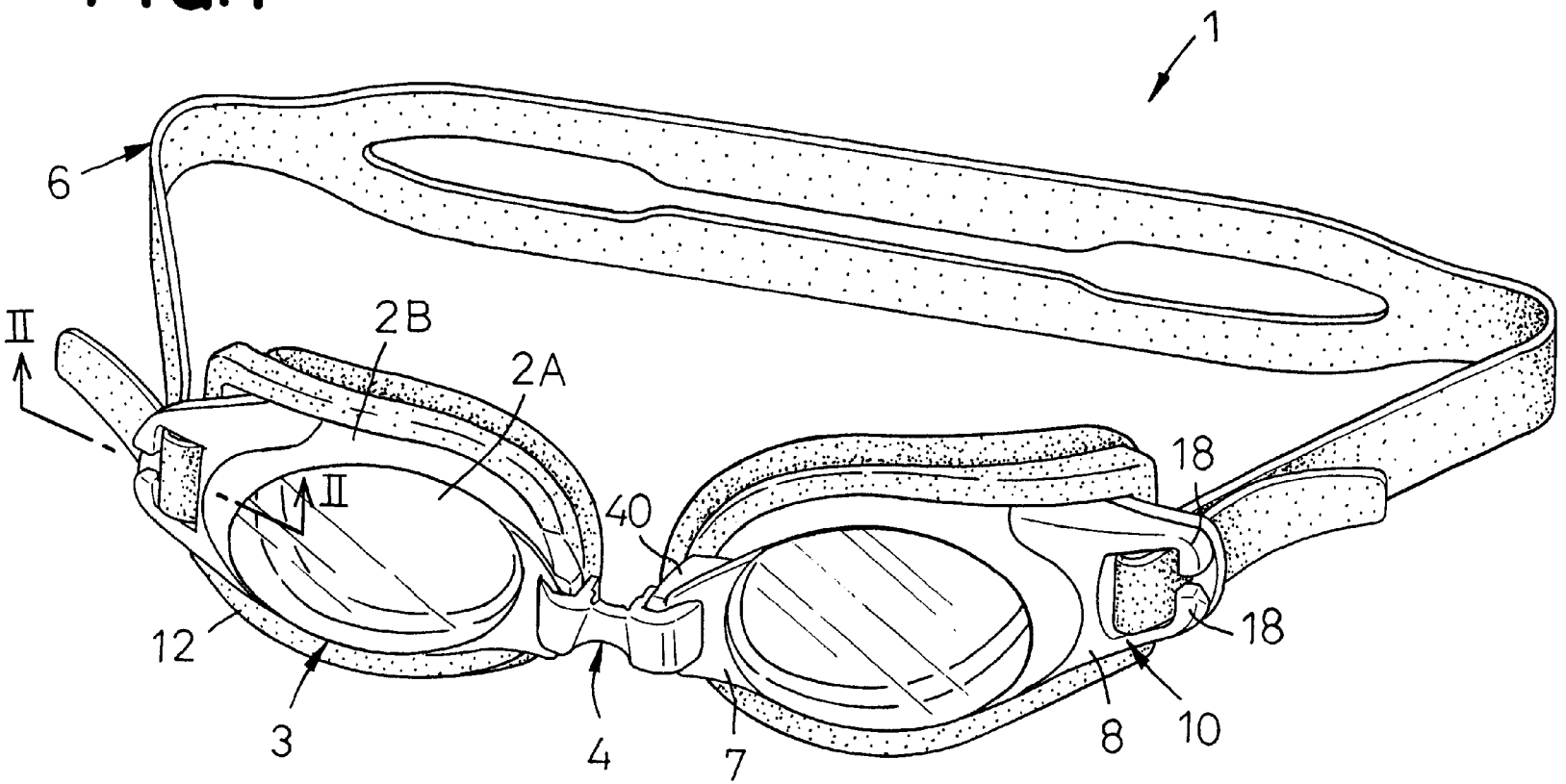
FIG. 1 is a perspective view of a pair of swimming goggles according to this invention.

Swimming goggles 1 shown by FIG. 1 in a perspective view are arranged so that a pair of lens assemblies 3, each comprising a lens 2A and a frame 2B which are integrally molded, are joined together by a bridge 4 that, in use, lies in front of a wearer's nose, on one hand, and by a head strap 6 adapted to be fastened around the wearer's head, on the other hand. Each of the lens assemblies 3 is made of hard plastic and is formed at its transversely inner end 7 lying adjacent the nose of the wearer with an end wall 40 protruding forward, by which the bridge 4 is detachably locked to the lens assemblies 3. At an outer end 8 of the lens assemblies 3 lying nearer to the back of the wearer's head, the head strap is length-adjustably held by a strap retaining member 10 which is provided separately of the lens assembly 3. A flange 11 (See FIG. 2) formed around the lens assembly 3 carries an annular cushioning pad 12 made of soft and elastic material.

Figure 2:
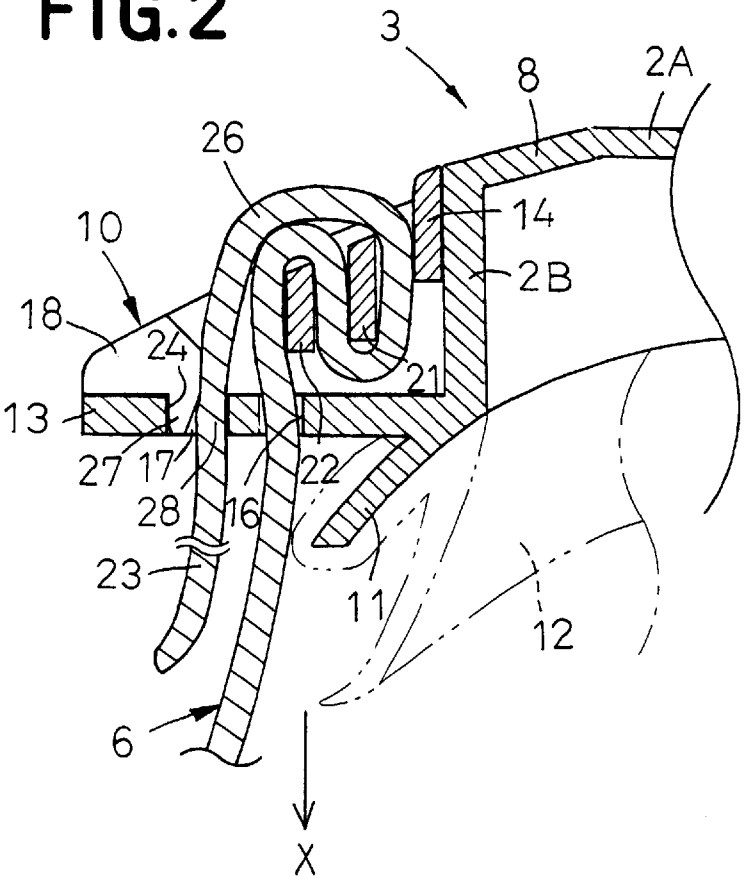
FIG. 2 is a sectional view taken along a line II—II in FIG. 1 and viewed in the direction as indicated by arrows in the same figure.

FIG. 2 is a sectional view taken along a line II—II in FIG. 1 and viewed in the direction as indicated arrows in the same figure, in which the cushioning pad 12 is indicated by chain lines. At the outer end 8 of the lens assembly 3, a flange-like portion 13 extends laterally from the frame 2B and the strap retaining member 10 is attached to the upper side of this flange-like portion 13 so that a peripheral wall of the retaining member 10 is placed at a part thereof against the frame 2B. The flange-like portion 13 is formed at its location near the frame 2B with an inner strap guiding hole 16 and its location remote from the frame 2B with an outer strap guiding hole 17. On the other hand, the strap retaining member 10 is formed with a pair of arms 18 which are opposed to each other in the vertical direction as viewed in FIG. 1. The strap retaining member 10 is additionally formed with inner and outer strap supports 21, 22 extending in parallel to each other in the vertical direction also as viewed in FIG. 1. The pair of arms 18 as well as the inner and outer strap supports 21, 22 are transversely spaced from each other, respectively, so that the strap 6 can be guided between the pair of arms 18 as well as between the inner and outer strap supports 21, 22.

The head strap 6 is elastic and made of rubber. After having been guided through the inner guiding hole 16 of the lens assembly 3 from the rear of the lens assembly 3, the free end 23 of the head strap 6 is guided through a gap defined between the arms 18 and the outer support 22, a gap defined between the outer support 22 and the inner support 21 and a gap defined between the inner support 22 and the peripheral wall 14 of the strap retaining member 10 in this order. Thereafter, the free end 23 is turned over and guided through the outer guiding hole 17 of the flange-like portion 13 and extend rearward.

With this arrangement, there is no apprehension that the head strap 6 might easily fall off from the lens assembly 3 even when the strap 6 is pulled rearward in the direction as indicated by an arrow X. This is because that the strap 6 is folded twice or more by the inner and outer supports 21, 22 of the strap retaining member 10, on one hand, and turning over of the free end 23 presses two sections of the strap 6 against each other at a location 26, on the other hand. In addition, a wedge-shaped stopper 27 formed integrally with the arms 18 of the strap retaining member 10 may be inserted, more preferably forced into a gap defined between a peripheral wall 24 of the strap guiding hole 17 and the strap 6 to ensure that the strap 6 is more reliably prevented from falling off from the lens assembly 3. Even if the strap 6 repeats its expansion and contraction in the direction as indicated by the arrow X and in the reverse direction, respectively, the portion of the strap 6 repeating such repeated expansion and contraction is kept free from frictional contact with a portion 28 of the strap 6 which is clamped by the wedge-shaped stopper 27. This means that the stopper 27 is substantially free from a force tending to pull the strap 6 forward out from the outer guiding hole 17. Accordingly, the length of the head strap 6 once adjusted is well maintained even after the swimming goggles 1 have repeatedly been put on and taken off.

Figure 3:
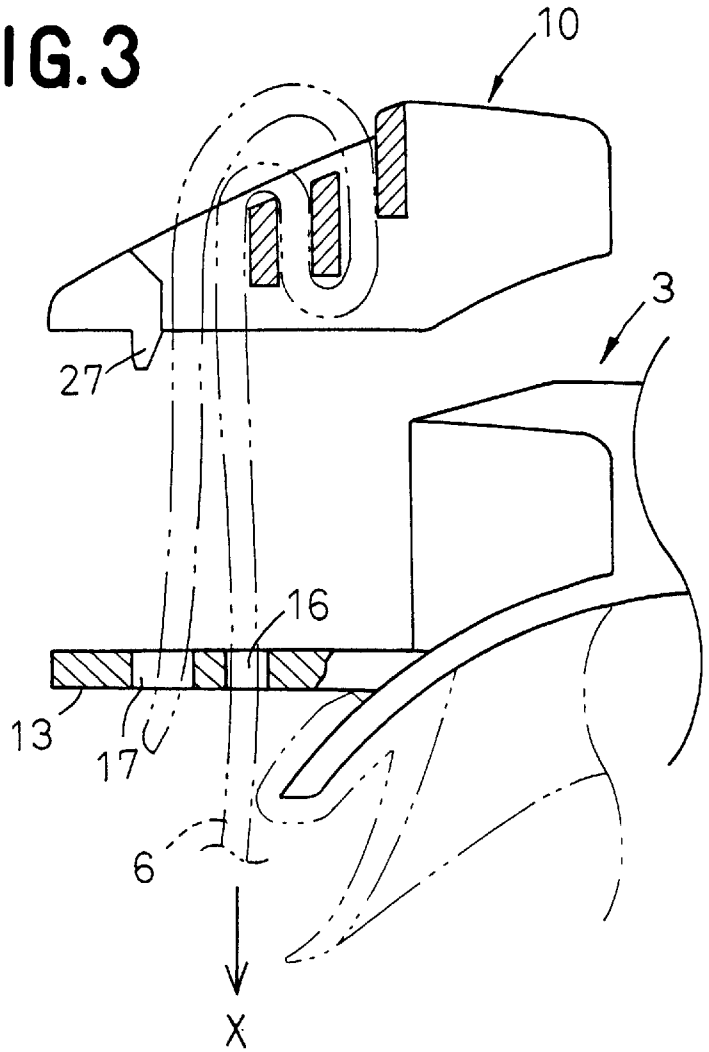
FIG. 3 is a view similar to FIG. 2 showing a lens assembly and a strap retaining member as they are detached from each other.

FIG. 3 is a view similar to FIG. 2, in which the strap retaining member 10 has been detached from the lens assembly 3 and in which the head strap 6 is indicated by chain lines. With the strap retaining member 10 being at the position relative to the lens assembly 3 as shown, the head strap 6 may be guided through the flange-like portion 13 and the retaining member 10. The strap retaining member 10 is placed upon the flange-like portion 13 as the strap 6 is pulled in the direction as indicated by the arrow X. Thereupon, the wedge-shaped stopper 27 of the strap retaining member 10 is forced into the outer guiding hole 17.

While the strap retaining member 10 and the lens assembly 3 are illustrated as being provided separately from each other, it is also possible without departing the spirit and scope of this invention to unitize strap retaining member 10 and lens assembly 3. It should be understood that a member corresponding to the wedge-shaped stopper 27 should be provided as a separate member when the members 10, 3 are unitized. A thickness of the wedge-shaped stopper 17 is preferably dimensioned so that the stopper 17 can be pressed against the strap 6.

With the swimming goggles according to this invention, the length of the head strap once adjusted is well maintained even after the swimming goggles have been repeatedly put on and taken off. This is achieved by the unique arrangement of this invention such that the portion of the head strap destined to repeat expansion and contraction is guided through the guiding hole provided independently of the guiding hole through which the portion of the strap to be fixed is guided.

What is claimed is:

1. Swimming goggles having a pair of lens assemblies coupled together by a bridge and comprising:

a pair of first strap guiding holes formed on transversely opposite sides of the coupled pair of lens assemblies;

a pair of second strap guiding holes formed transversely adjacent the pair of first strap guiding holes;

a pair of strap retaining members having stopper members; and a head strap having longitudinally opposite free ends each configured to be guided through one of said pair of first strap guiding holes from a rear toward front, front thereof, then to be folded at least twice along strap supports formed on said pair of strap members retaining and thereby to be length-adjustably fixed to said opposite sides of the coupled pair of lens assemblies, each free end of the head strap that is folded at least twice along said strap supports is guided from a front toward a rear through one of the second strap guiding holes, and each of the pair of stopper members is removably inserted into gaps defined between peripheral walls of said second guiding holes and said free ends of the head strap in order to prevent said free ends of the head strap from coming out of said second guiding holes from the rear toward the front.

2. Swimming goggles according to claim 1, wherein, after being folded at least twice along said strap supports, said free ends of the head strap extending from the front toward the rear is brought in close contact with the portion of the head strap having already left said first guiding holes and thereafter are guided through said second guiding holes so as to be spaced from said portion of the head strap.

3. Swimming goggles according to claim 1 wherein the pair of strap retaining members are detachable from the pair of lens assemblies.

4. Swimming goggles according to claim 1, wherein the pair of strap retaining members are formed integrally with the pair of lens assemblies, and the stopper members are formed separately from the pair of strap retaining members.

* * * * *